US012030602B2

(12) United States Patent
Golden

(10) Patent No.: US 12,030,602 B2
(45) Date of Patent: Jul. 9, 2024

(54) BOAT LIFT LIMIT SWITCH

(71) Applicant: William Golden, North Fort Myers, FL (US)

(72) Inventor: William Golden, North Fort Myers, FL (US)

( * ) Notice: Subject to any disclaimer, the term of this patent is extended or adjusted under 35 U.S.C. 154(b) by 378 days.

(21) Appl. No.: 17/540,798

(22) Filed: Dec. 2, 2021

(65) Prior Publication Data

US 2022/0177089 A1 Jun. 9, 2022

Related U.S. Application Data

(60) Provisional application No. 63/120,812, filed on Dec. 3, 2020.

(51) Int. Cl.
*B63C 3/06* (2006.01)

(52) U.S. Cl.
CPC ..... *B63C 3/06* (2013.01)

(58) Field of Classification Search
CPC ..... B63C 3/06; B63C 3/00; B63C 3/12
USPC ..... 405/1, 3
See application file for complete search history.

(56) References Cited

U.S. PATENT DOCUMENTS 3,025,984 A * 3/1962 Klingele ..... B63C 3/06 414/460
5,810,508 A * 9/1998 Norfolk ..... B66D 1/14 74/606 R

* cited by examiner

*Primary Examiner* — Sean D Andrish
(74) *Attorney, Agent, or Firm* — William E. Noonan

(57) ABSTRACT

A limit switch device for a boat lift includes a lower gear connected to and rotated by a drive shaft of the boat lift, and an interengaged upper gear operatively connected to an electronics module of the limit switch. The interengaged gears are enclosed within a gear housing that is sufficiently narrow to restrict the gears from laterally disengaging one another. The limit switch electronics module is mounted above the drive shaft and disposed interiorly of the gear mechanism. The module does not protrude beyond the frame bearing blocks that rotatably support the drive shaft and winder of the boat lift.

20 Claims, 4 Drawing Sheets

BOAT LIFT LIMIT SWITCH

RELATED APPLICATION

This application claims the benefit of application Ser. No. 63/120,812, filed Dec. 3, 2020.

FIELD OF THE INVENTION

This invention relates to a boat lift limit switch and, more particularly, to a switch apparatus that limits the degree to which the vessel-supporting platform of a boat lift may be lowered or raised.

BACKGROUND OF THE INVENTION

Boat lifts commonly employ a limit or auto-stop switch to stop operation of the lift when it reaches a predetermined height or vertical position, either during raising or lowering of the lift platform. Limit switches employed on conventional post lifts tend to exhibit a number of problems. These devices are unduly bulky and frequently interfere with positioning the boat in its slip or on the lift. The vessel risks striking the limit switch which can cause damage to the switch and/or to the boat. Unwieldy limit switch devices can also intrude on the free and unhindered movement of boat operators, passengers and service personnel in the vicinity of the lift and supported vessel.

Existing boat lift limit switch devices are further subject to occasional failure, particularly when they become overheated. Such devices often employ fairly thick interengaged metal gears that interconnect the electronic components of the switch to a winder-supporting drive shaft of the lift. The limit switch electronically counts the rotations of the shaft and generates a representative signal, which is processed to stop operation of the lift when a predetermined or preprogrammed rotation count is reached. If the gears overheat excessively, they are apt to disengage, which will disrupt the required shaft rotation count. As a result, in such situations, the limit switch device will not work. This can result in potential damage to the boat lift and/or the supported vessel. The gears in conventional limit switches present an even greater risk of disengagement and resultant switch failure due to the excessive width of the housing in which those gears are accommodated. The wide space formed within the housing permits the interengaged gears to shift laterally relative to one another a sufficient amount to cause the gears to disengage from each other. This is especially apt to occur when the gears are overheated. Once again, this is likely to cause the switch to fail.

SUMMARY OF THE INVENTION

It is therefore an object of the present invention to provide a boat lift limit switch device featuring a compact, ergonomic and low profile configuration, which does not interfere with or intrude upon the operation of boats or impede the movement of persons in the vicinity of the boat lift.

It is a further object of this invention to provide a boat lift limit switch device that features a significantly improved and more reliable gear mechanism employing thinner interengaging gears composed of plastic and a much narrower and more closely conforming gear housing that holds the gears effectively interengaged.

It is a further object of this invention to provide a boat lift limit switch device that significantly reduces the risk of excessive gear overheating and disengagement during operation of the boat lift, as well as the resulting risk of limit switch failure and potential damage to the lift and supported vessel.

It is a further object of this invention to provide a boat lift limit switch device that more compactly and ergonomically integrates the limit switch electronics and gear mechanism with the drive shaft of the boat lift such that various problems commonly exhibited by conventional boat lift limit and auto-stop switches are overcome.

This invention features a boat lift limit switch for stopping the axial rotation of a boat lift's winder-supporting drive shaft when a predetermined degree of axial rotation by the drive shaft has been detected. The limit switch is adapted for use with an axially rotatable drive shaft mounted to and extending between a pair of opposing first and second rotary bearing blocks. A boat lifting cable wound about the winder is selectively raised and lowered by axially rotating the shaft in respective opposite directions. This, in turn, raises and lowers a boat-supporting lift platform or frame attached to the cable. The limit switch includes an electronic module supported above the drive shaft and a limit switch gear mechanism that operably interconnects the electronic module and the drive shaft. The limit switch gear mechanism includes interengaged upper and lower gears accommodated within a gear housing. The lower drive gear is coupled to and axially rotated by the drive shaft. The upper driven gear is axially rotatably coupled to the electronic module of the limit switch device such that rotation of the drive shaft causes the lower drive gear to turn the interengaged upper driven gear, which in turn, directs the electronic module to generate a signal representative of the axial rotation of the drive shaft and the corresponding vertical position of the lift platform. Such generated signals are used to control a motor, which is directed to stop operation of the lift when a predetermined rotation count and corresponding vertical position is reached. The electronic module is configured so that it is confined between and does not extend laterally outwardly beyond either of the rotary bearing blocks. The gear housing is disposed adjacent to the first bearing block and an interior compartment of the housing, which accommodates the interengaged gears, has a width that is less than the combined width of the upper and lower gears. As a result, the gears are effectively constrained and prevented from laterally disengaging one another within the interior compartment of the gear housing.

In a preferred embodiment, the limit switch is mounted on a frame that encloses and rotatably supports the drive shaft. The frame may be defined by the opposing first and second bearing blocks and a plurality of elongate walls that extend between and are attached to the bearing blocks. The drive and driven gears may include interengaged spur gears. The driven gear may be connected to an axial limit switch coupler, which interengages an axially rotatable spindle operatively connected to the electronic module. The drive gear may axially support a winder coupler for coupling the lower gear to the drive shaft. The housing of the gear mechanism may include a semi-circular interior plate having a central recess that receives the limit switch coupler. The housing may further include an outer cover that interengages the interior plate and the first bearing block to form the interior compartment that accommodates the interengaged upper and lower gears of the gear mechanism.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
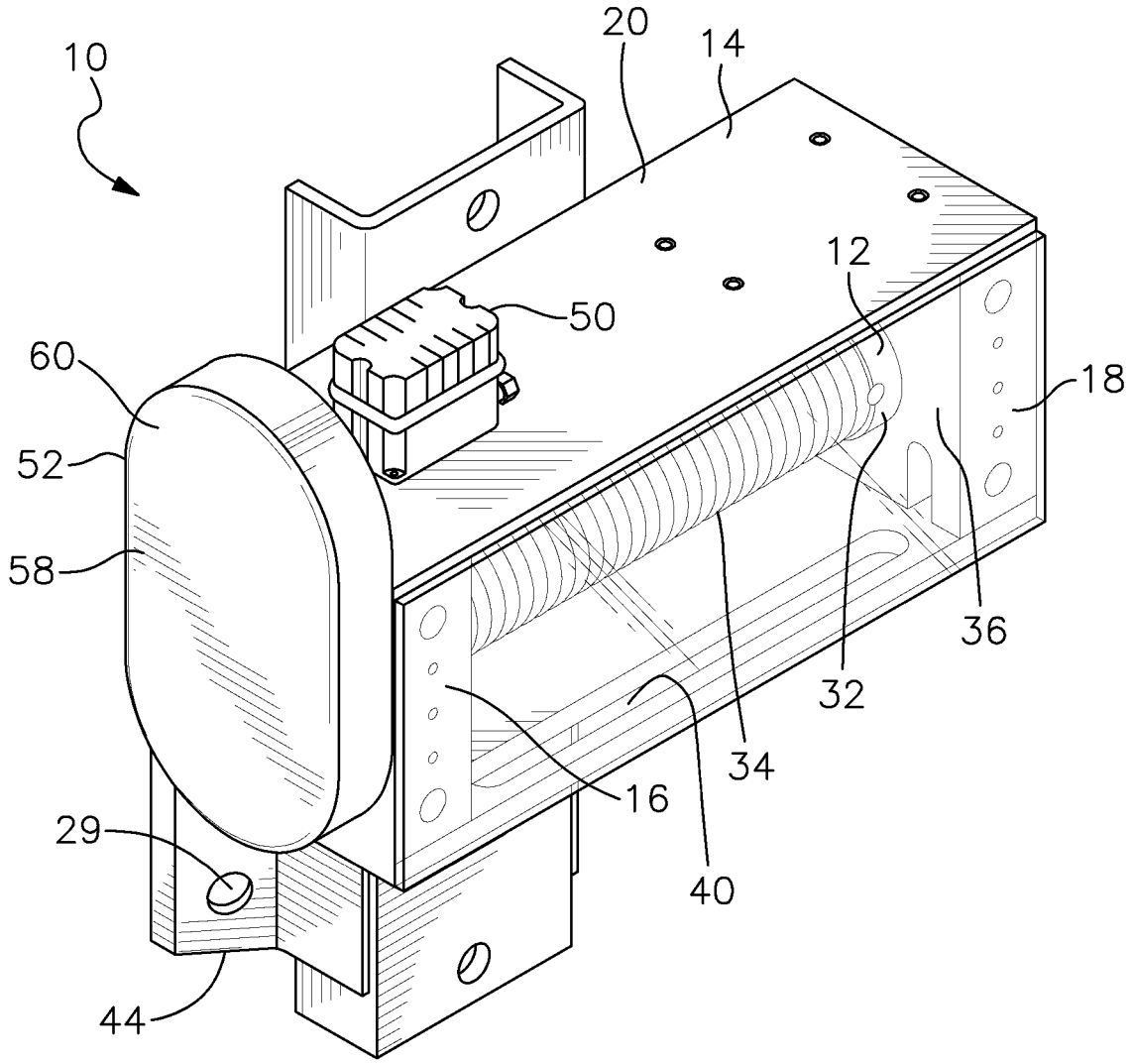
FIG. 1 is a front perspective view of a preferred version of the limit switch device of this invention mounted on the left hand end of the frame supporting a boat lift drive shaft and winder.
Figure 2:
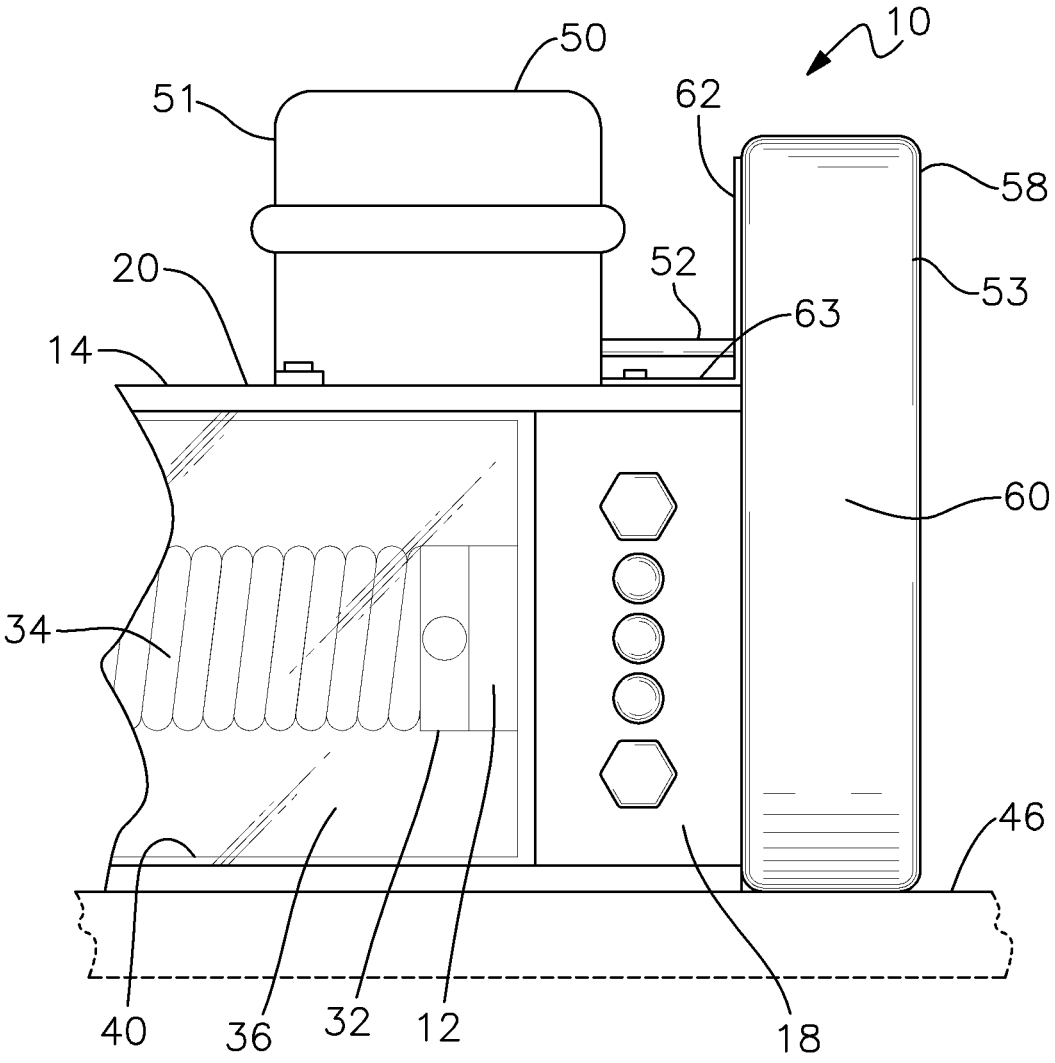
FIG. 2 is a front view of a slightly modified limit switch as mounted on the opposite righthand end of the boat lift drive shaft frame.
Figure 3:
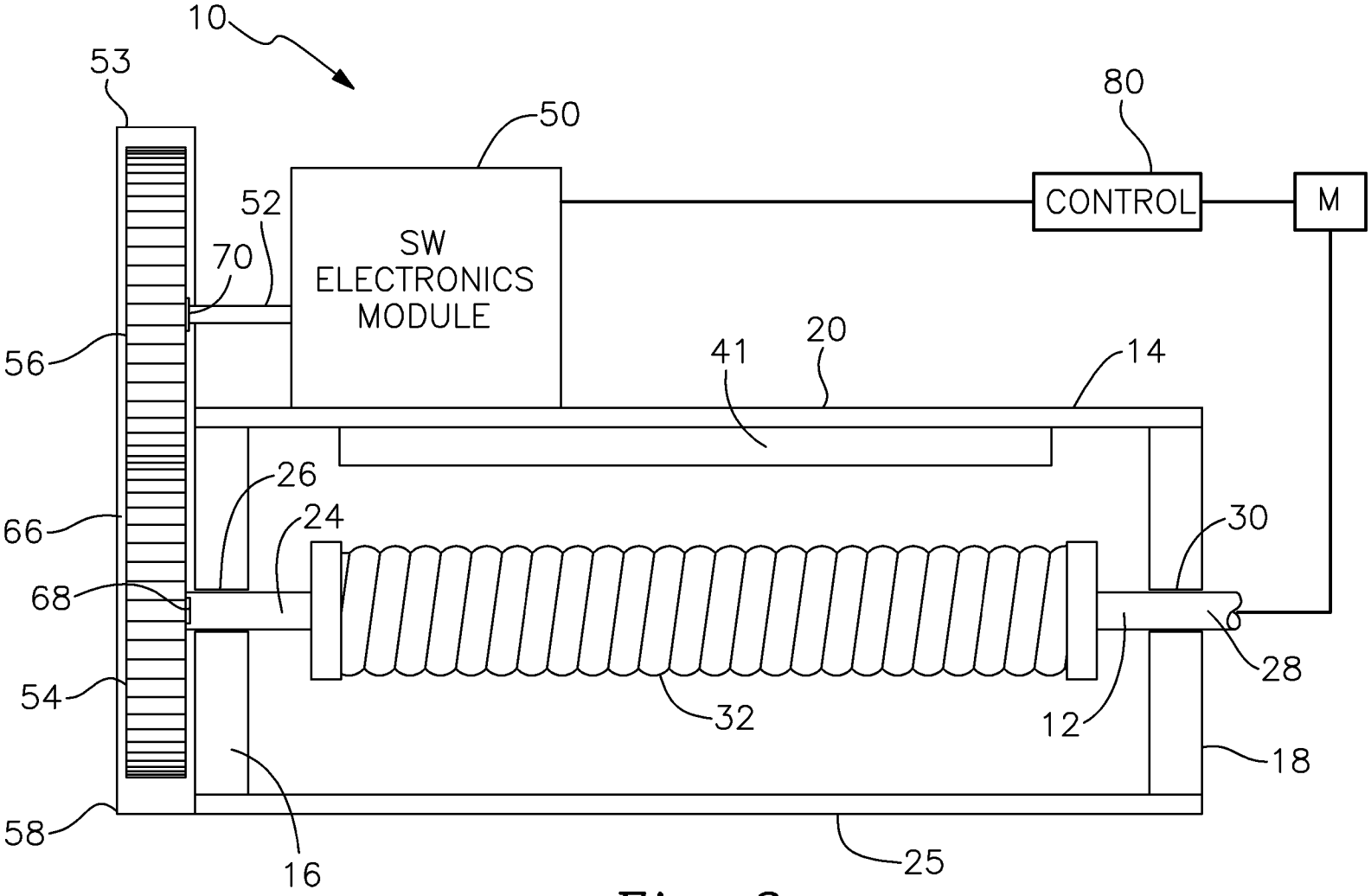
FIG. 3 is schematic view of the limit switch device of FIG. 1.
Figure 4:
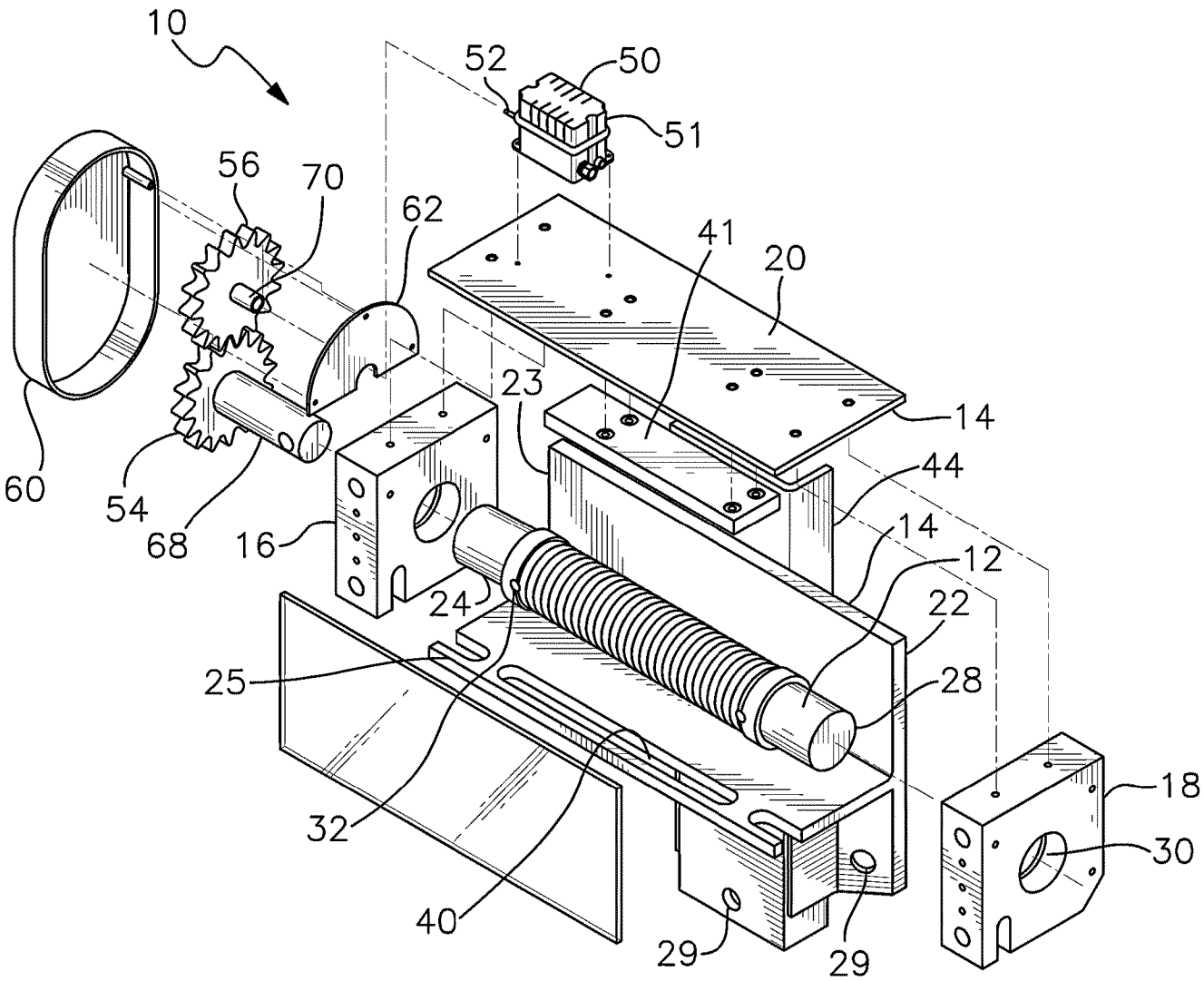
FIG. 4 is an exploded perspective view of the limit switch device of FIG. 1, as well as the pertinent components of the boat lift drive shaft and drive shaft frame to which the limit switch device is mounted.

There is shown in FIGS. 1-4 a boat lift limit switch device 10 that is operatively connected to a cable winder-supporting drive shaft 12 of the lift. The version depicted in FIG. 2 is largely analogous to that shown in FIGS. 1, 3 and 4 and identical reference numerals are used for corresponding parts. In FIGS. 1, 3 and 4 switch 10 is shown mounted proximate the left hand end of drive shaft 12, whereas FIG. 2 shows the switch positioned at the right hand end of shaft 12. Other minor differences are described below. The overall boat lift may employ various structural components such as one or more motors, winders and cables, a platform or frame featuring components including bunk boards and cradle beams, and other structural components (e.g. beams, posts and extrusions) that will be understood to persons skilled in the boat lift art. Limit switch device 10 may be used with assorted varieties of boat lifts featuring different types of drive mechanisms and power systems. The type, capacity and overall construction of the lift itself is not a limitation of this invention.

Drive shaft 12 is axially rotatably mounted within an elongate support frame 14. The support frame includes a pair of rotary bearing blocks 16 and 18 disposed at opposite ends of frame 14. Drive shaft 12 includes a cylindrical first end portion 24, FIGS. 3 and 4, that is received by and axially rotatable within a circular opening 26 of bearing block 16. The opposite second cylindrical end portion 28 of the drive shaft 12 is received by and axially rotatable in a corresponding circular opening 30 in bearing block 18. The drive shaft carries a cable winder 32 that extends between cylindrical ends 24 and 28 of drive shaft 12. Winder 32 supports a boat lift cable 34, FIGS. 1, 2 and 4, that is wrapped or wound about the winder in a conventional manner. A spiral groove is typically formed circumferentially about winder 32 to accommodate cable 34.

Frame 14 includes a top plate 20 that extends between and is attached to the upper surfaces of blocks 16 and 18. Plate 20 is attached to the bearing blocks by machine screws or other forms of attachment. An elongate angle piece 22, best shown in FIG. 4, has a generally L-shaped cross sectional configuration and extends longitudinally between blocks 16 and 18. Piece 22 is likewise secured to the bearing blocks by screws, bolts or other types of fasteners. Piece 22 forms a back wall 23 and a floor 25 of frame 14. As best shown in FIGS. 1 and 2, when the supportive frame is assembled, the front of frame 14 includes an opening 36 (covered by an optional window) that exposes the winder 32 and supported cable 34 within the frame. Floor 25 includes a longitudinal slot 40. Cable 34 depending from winder 32 passes longitudinally through slot 40 as the winder is operated to selectively raise and lower the boat lift cable. As shown in FIG. 4, a cable keeper pad 41 may be mounted to the inside surface of top plate 20 to restrict overlapping and potential entanglement of the cable as the drive shaft and winder are operated.

Supportive frame 14 and the drive shaft and winder mounted therein are attached to and supported by various other known components of the boat lift such as beams, extrusions, posts, etc. For example, as shown in FIG. 1, a mounting bracket 44 is secured to back wall 23 of piece 22. The bracket includes mounting holes 29 for securing the support frame to selected structural components of the boat lift. Alternatively, as shown in FIG. 2, frame 14 may be mounted on a horizontal beam 46.

Limit switch 10, which comprises the critical component of this invention, includes an electronic switch module 50 and a limit switch gear mechanism 53. Module 50 includes an exterior body 51 that is secured to frame 14 by screws interengaged with corresponding openings in top plate 20. The body encloses internal electronic components that operate in a manner analogous to known limit switch devices utilized in the boat lift industry. Such electronic components typically count the rotations of the drive shaft and provide representative signals of such movement to a conventional motor and motor control of the boat lift, which, in turn, limit rotation of the drive shaft so that the boat lift is not raised or lowered beyond predetermined vertical heights or levels. Module 50 carries an axially rotatable spindle 52, best shown in FIGS. 3 and 4, which extends from body 51 and is operatively coupled to limit switch gear mechanism 53 in the manner described more fully below. Body 51 of module 50 is configured such that the limit switch module is confined between the longitudinal ends of top plate 20 and frame 14. Body 51 is configured so that, unlike conventional limit switches, it does not extend or project beyond the outer edge or wall of either bearing blocks 16 or 18, as applicable. See FIG. 2. This prevents the electronic module from protruding beyond the supportive frame 14 and into the boat slip where it is conventionally subject to being struck and potentially damaged by a vessel maneuvering within the slip. Module 50 is mounted in a convenient location spaced sufficiently inside the outer edge of the proximate bearing block to eliminate this problem.

Gear mechanism 53 includes operatively interengaged lower (drive) and upper (driven) spur gears 54 and 56, respectively, which are enclosed in a gear housing 58. Housing 58 is defined by an outer cover 60 having curved upper and lower ends and an inner, generally semi-circular interior face plate 62 with an arcuate upper edge that interengages and is secured to bearing block 16. In the embodiment shown in FIG. 2, gear mechanism 53 abuts right bearing block 18 and plate 62 includes a lower flange 63 that is bolted to top plate 20 of frame 14. In the version shown in FIG. 4, plate 62 is secured to complementary pins carried by cover 60.

Lower and upper gears 54 and 56 are preferably composed of durable plastic and are configured and cut by a waterjet. Preferably, each has a thickness of approximately 0.75 inches which is considerably thinner than limit switch gears of the prior art. Assembled housing 58 includes an interior compartment 66, FIG. 3, which is likewise extremely thin or narrow. Preferably, the distance between the inside wall of cover plate 60 and the outer surface of interior face plate 62 (i.e., the width of compartment 66) is 1.5 inches or less. A width of 1.375 inches is especially preferred. The respective dimensions of the interengaged gears 54,56 and gear housing 53, as well as the plastic composition of gears 54 and 56, provide significant advantages as described more fully below.

Lower drive gear 54 is axially mounted on a drive shaft coupler 68, FIGS. 3 and 4. Upper gear 56 is similarly axially supported on a limit switch coupler 70. In each case, the gear is heat-welded to its respective coupler. As further shown in FIGS. 3 and 4, drive shaft coupler 68 is inserted into a central opening formed in first end portion 24 of drive shaft 12. Coupler 68 and end portion 24 of drive shaft 12 are interconnected by a set screw or other locking element. As a result, lower gear 54 is joined to and axially rotated by drive shaft 12.

Similarly, upper driven gear 56 is coupled to switch electronics module 50. In particular, limit switch coupler 70 includes a central opening that receives axially rotatable spindle 52 of switch module 50. Coupler 70 and spindle 52 are secured together, again by an appropriate set screw or locking pin. As a result, when upper gear 56 is rotated, this causes spindle 52 to rotate, which in turn, operates the internal electronic components of module 50 in a conventional manner to record the axial rotations of the lower gear 54 interengaged with upper gear 56 and, accordingly, the axial rotations of drive shaft 24 and winder 32 mounted thereon.

In operation, drive shaft 12 and supported winder 32 are rotated to cause lower gear 54 to turn within compartment 66 of gear housing 58. Rotation of lower gear 58 causes interengaged upper gear 56 to likewise rotate within housing 58. The upper gear thereby turns coupled spindle 52. The limit switch electronics within module 50 detect rotation of spindle 52 in a conventional manner and generate signals representing the rotation count of the drive shaft. Those signals are sent to a control device 80, which controls the operation of motor M. The motor can include any type of motor (e.g., electric, hydraulic) conventionally employed in the boat lift industry. Motor M is operatively coupled to the drive shaft in a known manner and responds to signals from limit switch module 50 and control 80 to halt operation of the drive shaft and either raising or lowering of the boat lift when predetermined rotation count parameters are detected and corresponding signals are generated from module 50.

The drive shaft 12, winder 32, frame 14 and components of those parts are preferably composed of marine grade metals and metal alloys suitable for use in the marine industry. Durable synthetic materials may also be employed. Gear housing 58 may include an analogous composition. Conventional durable and water resistant plastic may be employed for the switch module body. The dimensions of the various components described herein may be varied within the scope of the invention, although the compact and ergonomic configuration of the switch module and gear mechanism as previously described are particularly important to achieve the optimal benefits of this invention.

The construction of limit switch device 10 indeed yields significant benefits and overcomes a number of problems exhibited by the prior art. As previously indicated, electronics module 50 is mounted securely and unobtrusively above the drive shaft. Module 50 is positioned well inside the outer longitudinal edge of the support frame 14 and respective outer edges of bearing block 16, 18. As a result, the module does not intrude into the boat slip and does not impede movement of a vessel into and out of the slip. In addition, the module is much less likely to be struck by a maneuvering vessel or attending equipment or attachments.

The configuration and construction of gear mechanism 52 also yields a number of benefits. The newly introduced plastic construction and much narrower width or thickness of the interengaged gears produces significantly less heat than is produced by the gears of limit switches conventionally used in the boat lift industry. Prior art gears tend to produce excessive heat that is apt to cause premature failure of the switch mechanism. This problem is effectively overcome by the thin plastic gears utilized in gears 54, 56 of mechanism 52. The narrow width and slim profile of gear housing 58 also provides significant benefits. The width of interior compartment 66 of housing 58 (i.e. 1.375 in.) is less than the combined width of the two interengaged gears (i.e. 1.5 inches). As a result, the teeth of the interengaged gears are constrained to remain in operative interengagement Gears 54 and 56 are prohibited by the width of the housing compartment 66 from laterally shifting enough to disengage the gears from one another. The gears are instead forced to remain in interengagement with one another within housing 58. This results in much less risk of a gear failure and resulting failure of the limit switch itself. In the past, such failure has presented the risk of serious damage to the vessel. The slim profile of the gears and gear housing, as well as the heat reducing construction and configuration of the gears significantly reduces the danger of limit switch failure during operation of the boat lift. In addition, the slim profile of the gear mechanism again makes the limit switch device much less likely to protrude from the boat lift in a manner that will subject the limit switch to being struck by a passing or maneuvering nearby vessel. The present limit switch is ergonomic and attractive and presents little, if any interference with surrounding vessels, equipment, dock accessories, boat operators, passengers, service/maintenance personnel or other persons using the boat lift.

Accordingly, the present invention relates to a limit switch device that effectively monitors rotation of a boat lift's drive shaft and winder to limit raising and lowering of the lift beyond predetermined and preprogrammed parameters.

Although specific features of the invention are shown in some of the drawings and not others, this is for convenience only, as each feature may be combined with any and all of the other features in accordance with this invention.

What is claimed is:

1. A boat lift limit switch for use in combination with a boat lift, the boat lift including a motor-driven, axially rotatable drive shaft mounted to and extending between a pair of opposing first and second rotary bearings, the drive shaft carrying a winder with a boat supporting cable wound thereon, the drive shaft being rotated selectively in a first direction to unwind the cable from the winder and in an opposite second direction to wind the cable onto the winder to respectively raise and lower a boat supported by the cable, said limit switch comprising:

an electronic limit switch module supported above the drive shaft; and a limit switch actuating gear mechanism operably interconnecting the drive shaft to said electronic limit switch module, said limit switch actuating gear mechanism including a lower drive gear for coupling to and being axially rotated by the drive shaft and an upper driven gear operably interengaged with said lower drive gear and for rotatably coupling to said electronic switch module such that rotation of the drive shaft causes said lower drive gear to turn said upper driven gear, which directs said electronic limit switch module to generate signals representing rotation of the drive shaft and stop rotation of the drive shaft and operation of the lift when a signal representing a predetermined drive shaft rotation parameter is generated; said interengaged lower drive gear and upper driven gear being accommodated in an interior compartment of a gear housing, said interior compartment of said gear housing having a width that is less than a combined width of said interengaged lower drive gear and upper driven gear, whereby said interengaged lower drive gear and upper driven gear are constrained to remain in operative interengagement when the drive shaft rotates.

2. The switch of claim 1 in which said drive shaft has an elongate configuration and said rotary bearings are formed in respective bearing blocks having respective outer walls that define ends of a longitudinal span of said limit switch, said electronic switch module being confined within and not extending beyond said longitudinal span.

3. The limit switch of claim 1 in which said switch module and said limit switch actuating gear mechanism are mounted on a frame that encloses and rotatably supports said drive shaft.

4. The limit switch of claim 3 in which said frame is defined by first and second bearing blocks that respectively incorporate said rotatable the rotary bearings and a plurality of elongate walls that extend between and are attached to said first and second bearing blocks.

5. The switch of claim 1 in which said lower drive gear and said upper driven gear include respective spur gears having interengaged teeth.

6. The switch of claim 5 in which said lower drive gear supports a winder coupler for coupling said lower drive gear to said drive shaft.

7. The switch of claim 5 in which said upper driven gear is axially connected to a limit switch coupler, which interengages an axially rotatable spindle operatively connected to said electronic limit switch module.

8. The limit switch of claim 7 in which said gear housing includes an interior plate with an arcuate upper edge and having a recess that receives said limit switch coupler.

9. The limit switch of claim 8 in which said electronic limit switch module and said limit switch actuating gear mechanism are mounted on a frame that encloses and rotatably supports said drive shaft, said frame being defined by first and second bearing blocks that respectively incorporate the rotary bearings and a plurality of elongate walls that extend between and are attached to said first and second bearing blocks and in which said housing of said gear mechanism further includes an outer cover that interengages said interior plate and said first bearing block to form said interior compartment for accommodating said interengaged lower drive gear and upper driven gear thereon.

10. The limit switch of claim 4 in which said elongate walls include a top plate on which said electronic limit switch module is mounted, a floor having a slot formed therein through which said cable longitudinally passes, and a back wall interconnecting said top plate and said floor.

11. The limit switch of claim 1 in which said predetermined drive shaft rotation parameter includes a predetermined drive shaft rotation count.

12. A boat lift limit switch assembly comprising:

a motor-driven, axially rotatable drive shaft mounted to and extending between a pair of opposing first and second rotary bearing blocks, said drive shaft carrying a winder with a boat supporting cable wound thereon, said drive shaft being selectively rotated in a first direction to unwind said cable from said winder and in an opposite, second direction to wind said cable onto said winder for respectively lowering and raising a boat supported by said cable;

a frame that encloses and rotatably supports said drive shaft, said frame being defined by first said and second rotary bearing blocks and a plurality of elongate walls that extend between and are attached to said first and second rotary bearing blocks;

an electronic limit switch module supported above said drive shaft by an upper plate comprising one of said elongate walls of said frame; and a limit switch actuating gear mechanism operably interconnecting said drive shaft to said electronic limit switch module, said limit switch actuating gear mechanism including a lower drive gear coupled to and axially rotated by said drive shaft and an upper driven gear operably interengaged with said lower drive gear and axially rotatably coupled to said electronic limit switch module such that rotation of said drive shaft causes said lower drive gear to turn said upper driven gear, which directs said electronic limit switch module to generate signals representing rotation of said drive shaft, said motor being responsive to said signals generated by said electronic limit switch module for stopping rotation of said drive shaft and operation of a lift when a signal representing a predetermined drive shaft rotation parameter is sensed by said motor; said interengaged lower drive gear and upper driven gear being accommodated in an interior compartment of a gear housing attached to a first one of said rotary bearing blocks, said interior compartment having a width that is less than a combined width of said interengaged lower drive gear and upper driven gear, whereby said interengaged lower drive gear and upper driven gear are constrained to remain in operative interengagement when said drive shaft rotates.

13. The limit switch assembly of claim 12 in which said drive shaft has an elongate configuration and said rotary bearing blocks have respective outer walls that define ends of a longitudinal span of said limit switch, said electronic limit switch module being confined within and not extending beyond said longitudinal span.

14. The limit switch assembly of claim 12 in which said lower drive gear and said upper driven gear may include respective spur gears with interengaged teeth.

15. The limit switch assembly of claim 12 in which said lower drive gear supports a winder coupler for coupling said lower drive gear to said drive shaft.

16. The limit switch assembly of claim 12 in which said upper driven gear is connected axially to a limit switch coupler, which interengages an axially rotatable spindle operatively connected to said electronic limit switch module.

17. The limit switch assembly of claim 16 in which said housing of said gear mechanism includes a semicircular interior face plate having a recess that receives said limit switch coupler.

18. The limit switch assembly of claim 17 in which said housing of said gear mechanism further includes an outer cover that interengages said interior face plate and an outer wall of said first bearing block to form said interior compartment for accommodating said interengaged lower drive gear and upper driven gear.

19. The assembly of claim 12 in which said lower drive gear and said upper driven gear are composed of plastic.

20. The limit switch assembly of claim 12 in which said compartment of said gear housing has a width not greater than 1.5 inches.

* * * * *